US005265804A

United States Patent [19]

Brunel

[11] Patent Number: 5,265,804

[45] Date of Patent: Nov. 30, 1993

[54] ELECTRICALLY CONTROLLED FUEL INJECTOR UNIT

[75] Inventor: Andre Brunel, St. Genis Laval, France

[73] Assignee: Robert Bosch GmbH, Stuttgart, Fed. Rep. of Germany

[21] Appl. No.: 996,339

[22] Filed: Dec. 23, 1992

[30] Foreign Application Priority Data

Dec. 24, 1991 [DE] Fed. Rep. of Germany ..... 4142940

[51] Int. Cl.[5] ..... F02M 51/06; F02M 57/02

[52] U.S. Cl. ..... 239/88; 239/125; 239/585.1; 123/506

[58] Field of Search ..... 239/88-96, 239/124-126, 585.1; 123/506, 500, 501, 458

[56] References Cited

U.S. PATENT DOCUMENTS 4,482,094 11/1984 Knape ..... 239/88
4,741,478 5/1988 Teerman et al. ..... 239/88
5,094,215 3/1992 Gustafson ..... 239/89

FOREIGN PATENT DOCUMENTS 0174718 3/1986 European Pat. Off. .
3521426 12/1986 Fed. Rep. of Germany .

*Primary Examiner*—Andres Kashnikow
*Assistant Examiner*—Karen B. Merritt
*Attorney, Agent, or Firm*—Edwin E. Greigg; Ronald E. Greigg

[57] ABSTRACT

An electrically controlled fuel injector unit for fuel injection in internal combustion engines, in which an injection pump, an injection nozzle, and between them a control valve and control magnet are fastened in a fuel injector unit housing. The control valve and the control magnet, including requisite conduits, are combined in a magnet valve housing to form a structural unit that is inserted as a whole into the fuel injector unit housing. The control valve and control magnet are disposed eccentrically in the magnet valve housing, and a high-pressure conduit that connects the pump work chamber to the injection nozzle extends on a side of the magnet valve housing having a greater accumulation of material resulting from the eccentricity.

20 Claims, 2 Drawing Sheets

ELECTRICALLY CONTROLLED FUEL INJECTOR UNIT

BACKGROUND OF THE INVENTION

The invention is based on an electrically controlled fuel injector for fuel injection in internal combustion engines, as defined hereinafter.

In a unit fuel injector of this generic type (German Offenlegungsschrift 35 21 426), the control valve is embodied as a ring valve and together with the electric control magnet is disposed coaxially around the injection pump and the pump work chamber. Although this produces good control forces, it also involves relatively large radial minimum dimensions and above all a relatively high number of high-pressure sealing faces, which must be very well machined if the necessary tightness is to be achieved.

In another known unit fuel injector of this type (European Patent Reference 0 174 718), the control valve and the control magnet are distributed axially over a relatively long portion of the unit fuel injector housing, which especially presents the problem of a large number of abutment points of the high-pressure conduit, each of which must be very well machined and sealed off, since any leak, however slight, falsifies the already predetermined injection quantity. Assembling the unit fuel injector also entails considerable effort, especially to coordinate the rotational position of the various parts so as to assure that the inlet and outlets of the various conduit segments are covered. Modern high-rpm engines require a very high switching frequency of these electrically controlled unit fuel injectors; even slight control errors in the injection quantity produce a considerable drop in engine efficiency and above all make for poorer emissions.

OBJECT AND SUMMARY OF THE INVENTION

The electrically controlled unit fuel injector according to the invention has an advantage above all that relatively few high-pressure sealing faces need to be machined for adequate tightness, and that the sealing faces are always located in parallel planes, so that in practice no undesirable leakage occurs in the high-pressure region. Moreover, installing what is now only a magnet valve housing in the unit fuel injector housing is substantially easier than inserting a relatively large number of individual parts that also have to be coordinated with one another in terms of their rotational position. This advantage becomes especially important in repair work, in which only the magnet valve housing, as a whole, needs to be replaced. At least, it is advantageous that no errors in installation can arise, for instance from leaving out parts or inserting parts wrong.

Although in principle it is known to supply the low-pressure fuel region via an annular groove encompassing the control valve, nevertheless precisely in the embodiment according to the invention this type of low-pressure fuel delivery is especially advantageous, because since a self-contained magnet valve housing is used inside the unit fuel injector housing, relatively easy separation between the high-pressure and low-pressure regions is possible, which as noted above is decisive for the efficiency of the system. The unit fuel injector is inserted in a known manner into a corresponding bore of the engine, and radial openings are present in the unit fuel injector housing, on the one hand for the low-pressure fuel delivery and on the other for fuel leakage; these two regions are separated via earrings disposed in the jacket face of the unit fuel injector housing. The fuel delivery and removal are done outside the unit fuel injector, in corresponding conduits disposed in the engine crankcase.

In another advantageous feature of the invention, the electric control magnet and the control valve are disposed eccentrically in the magnet valve housing; the portion of the high-pressure conduit extending through the magnet valve housing extends on the side of the magnet valve housing on which the accumulation of material resulting from the eccentricity is present. The special advantage of this eccentric arrangement and corresponding guidance of the pressure conduit portion resides in the substantial shortening of the total length of the pressure conduit between the pump work chamber and the injection nozzle. The fact that the confined volume in such a pressure conduit should be as small as possible plays a major role, because injection by unit fuel injectors, in particular, involves a high injection pressure, and as is well known, the Diesel fuel is considerably compressed. This compression of the fuel is expressed in an error in the control of fuel quantity, so that the fuel column in the high-pressure region should be as small as possible, as is the case in the invention.

In another advantageous feature of the invention, filling the pump work chamber is done via the control valve; that is, during the intake stroke of the pump piston, fuel flows from the low-pressure chamber into the pump work chamber via the control valve pressure chamber. In this way, fresh fuel always flows past the movable valve member of the control valve, and the result is continually repeated scavenging of the chamber. The actual control of the injection quantity can then be done in various ways. For instance, during the intake stroke of the pump piston, the control valve may allow only as much fuel as is later to be injected to flow through to the high-pressure region. Alternatively, the quantity can be controlled such that during the pumping stroke of the pump piston, the control valve is opened intermittently, and thus the fuel that is pumped by the pump piston can flow back into the low-pressure system. Once the control valve closes after the onset of the supply stroke, the injection onset can be controlled as a result, with a corresponding influence on the injection quantity; once the control valve opens toward the end of injection, the injection is interrupted and the control valve determines the end of injection.

In another advantageous feature of the invention, an equalization piston is disposed on the valve member of the control valve, in the low-pressure region on the side of the valve seat remote from the high-pressure chamber, on a connecting neck; this piston plunges into a bore of the housing that corresponds to its diameter, and for the sake of equalization of forces, this diameter is approximately equivalent to the effective diameter of the valve seat, and the chamber upstream of the face end of the equalization piston, which is now hydraulically disconnected from the low-pressure chamber, is predominantly pressure-relieved. As a result of this equalization of pressure in the low-pressure chamber of the control valve, the control quality upon fuel metering into the pump work chamber is improved, since no hydraulic pressure differences engaging the movable valve member of the control valve are superimposed on the forces of the control magnet. Superimposition of that kind is harmful especially if the pressures in the low-pressure chamber fluctuate, for instance if there is no pressure equalization and different pressures prevailed in this low-pressure chamber upon diversion of quantities of fuel from the pump work chamber, as happens in known fuel injectors.

In another advantageous feature of the invention, the magnet chamber surrounding the control magnet and other pressure-relieved chambers (face end chamber, spring chamber of the injection nozzle, etc.) are pressure-relieved to a groove, in particular an annular-groove, that is present between the magnet valve housing and the unit fuel injector housing and communicates with a leakage connection via a radial connection opening in the unit fuel injector housing. Because of the embodiment according to the invention, it is also relatively simple to extend the various leakage conduits to this groove, which is preferably disposed in the region of the magnet valve housing that surrounds the magnet chamber.

In another advantageous feature of the invention, a spring acting in the opening direction and disposed in the face end chamber engages the valve member of the control valve; according to the invention, the face end chamber and the bore for the pressure equalization piston are disposed in a capsule mounted on the magnet valve and secured there, and according to the invention, this capsule protrudes into a correspondingly coaxially disposed recess of a nozzle holder of the injection nozzle, and the face end chamber and the spring chamber of the injection nozzle are connected to one another hydraulically. Because the capsule protrudes into this recess of the nozzle holder, no axial strains reach the capsule, of the kind that otherwise exist when an injection pump, magnet valve housing and injection nozzle are pressed together.

In another advantageous feature of the invention, a connecting line with a throttle is present between the low-pressure region and the pressure-relieved region, so that continuous scavenging of the pressure-relieved region takes place.

In another advantageous feature of the invention, an intermediate plate is present between the magnet valve housing and the injection pump, and corresponding through conduits for the fuel or electric lines are disposed in the intermediate plate, which is radially sealed off from the unit fuel injector housing. According to the invention, this intermediate plate directly closes off the magnet chamber of the magnet valve on one side and the pump work chamber of the injection pump on the other. As a result, the high-pressure region—except for the pressure conduits—is disconnected from the low-pressure region and especially the magnet region. Because of the fluctuations (alternating high-pressure and low-pressure) arriving upon injection, influence on the frequencies of the control magnet, which differ even if only slightly, can arise, resulting in superimpositions and errors in metering. A solid intermediate plate of this kind brings about a corresponding decoupling.

In another advantageous feature of the invention, the pump housing comprises a pump housing that is open on the face end for the drive mechanism and a union nut that tightens the injection nozzle, with not only the injection nozzle but the magnet valve housing accommodated in the union nut.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
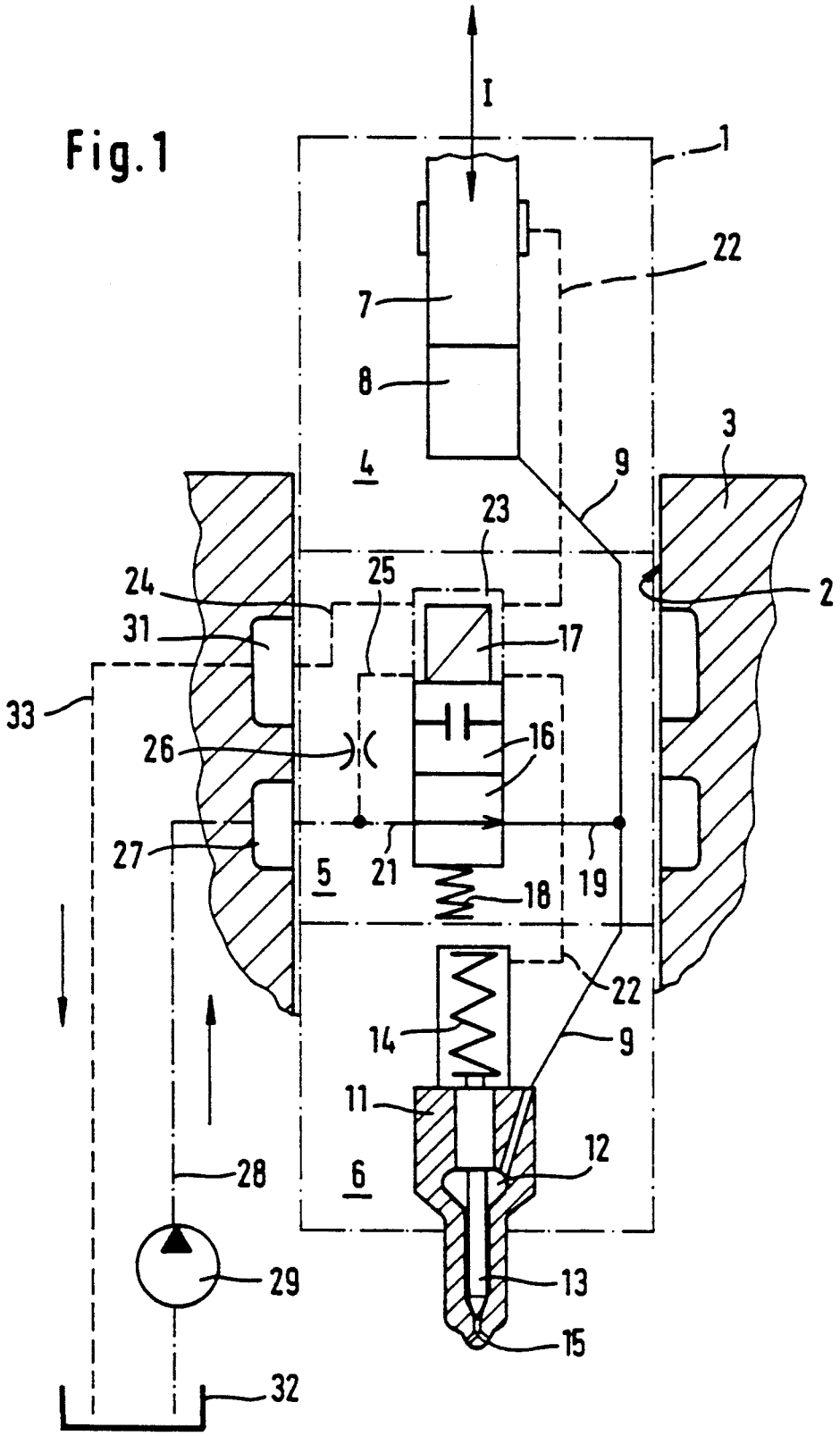
FIG. 1 is a functional diagram of a fuel injector unit.

In the diagram shown in FIG. 1, the dot-dash line represents the housing 1 with a fuel injector unit, which is inserted into a corresponding bore 2 of an engine 3. The fuel injector unit comprises an injection pump 4, a magnet valve 5, and an injection nozzle 6, which are substantially surrounded by the housing 1 of the fuel injector unit. The injection pump 4 has a pump piston 7 and a pump work chamber 8, which communicates with the injection nozzle 6 via a high-pressure conduit 9. The injection nozzle 6 has a nozzle body 11 with a nozzle pressure chamber 12 and a valve needle 13, which opens at adequate pressure of the fuel counter to the force of a closing spring 14, after which the fuel is injected into the engine combustion chamber via injection ports 15. The magnet valve 5 has a control valve 16, which is open when without current, and a control magnet 17; an opening spring 18 acts in the opening direction. The high-pressure conduit 9 has a branch 19 that leads to the control valve 16.

On the other side, a low-pressure line 21 leads to the control valve 16. Leakage conduits 22, shown in dashed lines, also extend in the injection pump 4, magnet valve 5 and injection nozzle 6, and they discharge into the magnet chamber 23 of the magnet valve 5, from whence a further leakage conduit 24 leads to outside the fuel injector unit housing 1. A connecting line 25, in which a throttle 26 for decoupling the low pressure from the leakage pressure is disposed, is provided between the low-pressure line 21 and the magnet chamber 23.

An annular groove 27 is disposed in the jacket face of the bore 2 of the engine 3 and communicates, as a low-pressure chamber, with the low-pressure conduit 21 of the magnet valve 5 on one end, and a feed line 28 of a fuel pump 29 that pumps at low pressure, discharges into this groove on the other end. An additional annular groove 31, hydraulically disconnected from the annular groove 27, is provided in the wall of the bore 2, and the leakage conduit 24 discharges into this groove, from which a leakage line 33 branches off, leading to a fuel tank 32.

The fuel injector unit schematically shown in FIG. 1 functions as follows:

The pump piston 7 is set into reciprocating motion as indicated by the double arrow I, especially by the engine camshaft, and in its compression stroke the pump piston pumps fuel from the pump work chamber 8 via the high-pressure conduit 9 into the pressure chamber 12 of the injection nozzle 6, so that once the injection pressure is reached, the valve needle 13, having been displaced counter to the closing spring 14, uncovers the injection ports 15, so that this fuel is injected into the combustion chamber of the engine. Filling of the pump work chamber 8 takes place during the upward intake stroke of the pump piston 7, in that fuel from the fuel tank 32 is pumped via the feed pump 29 and the feed line 28, the annular groove 27 and the low-pressure conduit 21, into the pump work chamber 8 via the control valve 16 and the corresponding portions 19 and 9 of the high-pressure conduit. In the electrically nonexcited state, the magnet valve 5 assumes the position shown. Fuel delivery into the pump work chamber 8 can accordingly occur only as long as the magnet valve is opened. Conversely, injection can take place only whenever the magnet valve 5 is blocked, or in other words whenever the control magnet 17 is electrically excited and the control valve 16 has switched over and is blocked. In this way, the fill quantity can be determined during the intake stroke and the injection onset and end can be determined during the compression stroke. Via the various leakage conduits, quantities of fuel entering between the high-pressure and low-pressure or leakage side are collected and returned to the fuel tank 32 via the annular groove 31 and the leakage line 33.

According to the invention, the magnet valve 5 is embodied as a separate part from the injection pump 4 and the injection nozzle 6 and is inserted as a unit into the fuel injector unit housing 1.

Figure 2:
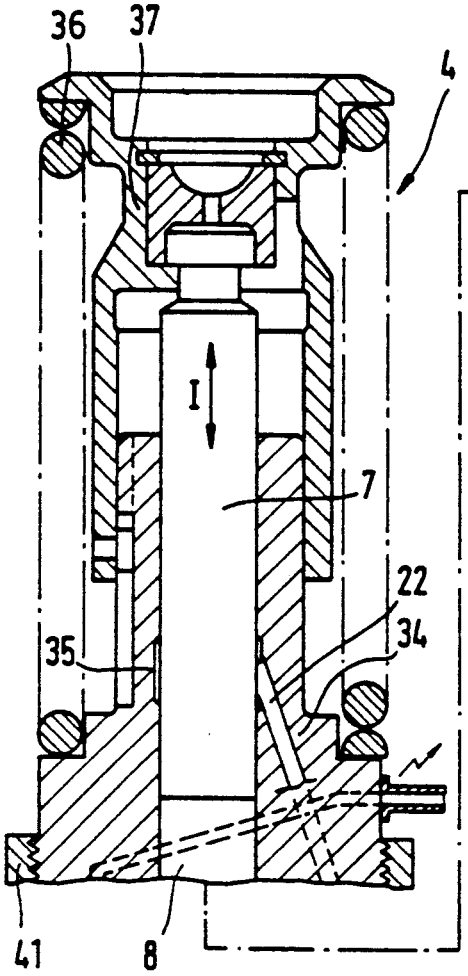
FIG. 2 is a staggered longitudinal section through the exemplary embodiment.
Figure 3:
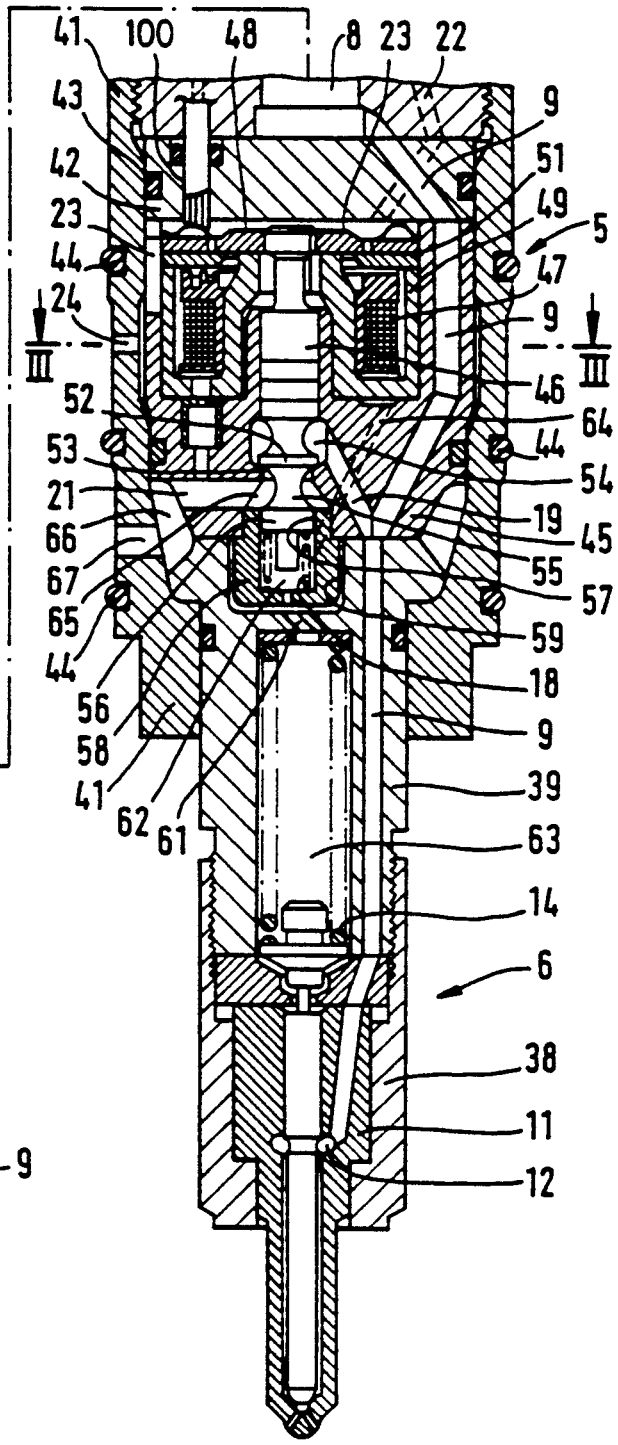
FIG. 3 is a cross section taken along the line III—III of FIG. 2.
Figure 3:
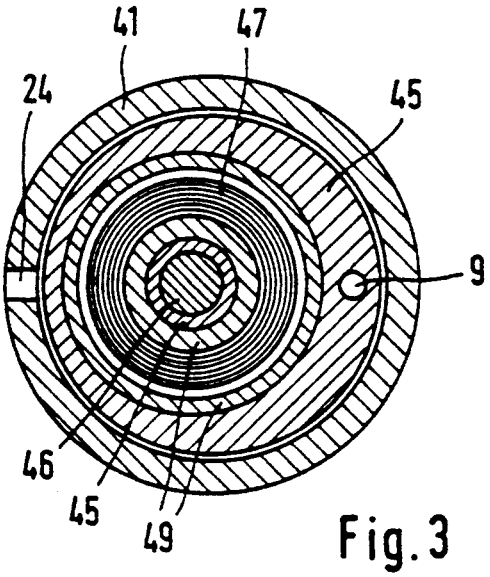

In the view of this fuel injector unit shown in FIG. 2, details of the fuel injector unit can be seen, and above all the fact that the magnet valve is in one piece is apparent. In FIGS. 2 and 3, the same reference numerals for FIG. 1 are also used.

The pump piston 7 of the injection pump 4 is radially sealingly and axially displaceably guided in a pump housing 34 and with the pump housing 34 it defines the pump work chamber 8. An annular leakage groove 35, from which one of the leakage conduits 22 branches off, is disposed in the bore that receives the pump piston 7. The pump piston 7 is driven in the intake stroke direction via a piston spring 36, which engages the pump piston 7 via a pump tappet 37; the engine camshaft engages this camshaft 37 at least indirectly in the compression stroke direction. The nozzle body 11 of the injection nozzle 6 is fastened by a nozzle unit nut 38 to a nozzle holder 39 in which the closing spring 14 is accommodated. The high-pressure conduit 9 is extended correspondingly through the nozzle holder 39 and the nozzle body 11 to the nozzle pressure chamber 12.

The nozzle holder 39 is fastened to the pump housing 34 by means of a union nut 41 that belongs to the housing of the fuel injector unit, and the pump housing 34 is also part of the fuel injector unit housing. The magnet valve 5 and, toward the injection pump 4, an intermediate plate 42 are fastened between a magnet valve housing 45 and the pump housing 34, inside the union nut 41. The intermediate plate 42 is sealed off on the outside from the union nut 41 by a toroidal sealing ring 43. The three toroidal sealing rings 44 are disposed on the jacket face of the union nut 41 in corresponding annular grooves, as a seal from the bore 2 receiving the fuel injector unit; as a result, the two annular grooves 27 and 31 (FIG. 1) are separated from one another and sealed off from the outside.

The magnet valve housing 45, includes an axial bore in which a movable valve member 46 is guided, radially, sealingly and axially displaceably; this movable valve member 46 is disposed coaxially with a magnet coil 47 of the control magnet 17, and both the valve member 46 and the magnet coil 47 are disposed eccentrically in the housing 45, as can be seen from FIG. 3. A portion of the high-pressure conduit 9 extends next to the magnet coil 47, longitudinally through the magnet valve housing 45, specifically on the side on which a corresponding accumulation of material is present because of the eccentricity. Since the electromagnet and the high-pressure conduit must be accommodatable next to one another in the magnet valve housing, the diameter of the magnet valve housing 45 can be minimized as a result of this eccentric arrangement. The magnet valve, with its relatively large magnet coil 47, is the part having the largest diameter in this kind of fuel injector unit; that is, the total diameter of the fuel injector unit is determined by this region. Yet the engine itself often puts very tight limits on precisely this total diameter. A conduit 100 is provided in the intermediate plate 42 and the housing 34 through which electrical wires are connected to the magnet coil 47.

For actuating the valve member 46, an armature plate 48 is disposed on one end of the valve member on one side, cooperating with a magnet cup 49 and a short-circuit yoke 51; the other end of the valve member 46 is loaded by the opening spring 18. A closing head 52 is also provided on the valve member 46 and cooperates on one side with a valve seat 53 structurally connected to the housing and is surrounded on the other side by a high-pressure chamber 54 of the magnet valve 5, which communicates with the branch 19 of the high-pressure conduit 9. A pressure equalization piston 56 that plunges into a damping bore 57 is disposed on the valve member 46, on the closing head 52 on the side toward the valve seat 53, via a connecting neck 55.

The damping bore 57 is provided in a capsule 58 that is secured coaxially with the valve member 46 to the magnet valve housing 45 after insertion and that protrudes from the magnet valve housing 45 in the direction of the injection nozzle 6. On the side of the nozzle holder 39 toward the magnet valve 5, a recess 59 is correspondingly provided, and there is a leakage conduit connection 61 between the face end chamber 62 enclosed by the capsule 58 and the nozzle spring chamber 63 disposed in the nozzle holder; the leakage conduit connection 61 communicates in turn, through a leakage conduit 64, with the magnet chamber 23, which communicates with the annular leakage conduit 31 (see FIG. 1), through the leakage conduit 24 that radially penetrates the union nut 41.

The connecting neck 55 is surrounded by a low-pressure chamber 65 into which the low-pressure conduit 21 discharges, which conduit discharges on its other end into a low-pressure annular groove 66 disposed between the union 41, magnet valve housing 45 and nozzle holder 39. A connecting bore 67 is provided between this low-pressure annular groove 66 and the annular groove 27 present in the engine 3.

The fuel injector unit described in its details here operates in the way described above in conjunction with the diagram shown in FIG. 1; the advantages referred to at the outset are clearly apparent in the view shown in FIG. 2. Relatively few axial high-pressure sealing faces are present, and moreover they can be well-machined. In addition, the fuel injector unit of the invention can be installed and also repaired quickly and simply. The volume of the high-pressure column, especially in the high-pressure conduit 9 and 19, has been minimized by the eccentric arrangement of the magnet, and this minimization also applies to the total diameter of the fuel injector unit.

All the characteristics described herein and shown in the drawing may be essential to the invention either individually or in any arbitrary combination with one another.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the U.S. is:

1. An electrically controlled fuel injector unit for fuel injection in internal combustion engines, comprising, a fuel injector unit housing (1) that includes at least two parts in an axial direction which are secured together, an injection pump including a pump piston (7) in said housing which is driven with a constant stroke, a control valve (16) for controlling a hydraulic connection of a low-pressure fuel system (27-29) to a high-pressure fuel system (7-15), an electric control magnet (17, 47-51) for actuating the control valve (16, 46, 52-58), and a fuel injection nozzle (6, 11-14) for the high-pressure injection disposed in said housing, a high-pressure conduit (9), that leads from a pump work chamber (8) of the pump piston (7) to said injection nozzle (6) and from which a branch conduit (19) leads to a high-pressure chamber (54) of the control valve (16), said control valve includes a movable valve member (46, 52) which controls a connection of said high-pressure chamber (54) to a low-pressure chamber (65), wherein hydraulically impinged spaces of the movable valve member (46) inside the high-pressure chamber (54) are largely pressure-equalized with respect to the control motion, and a low-pressure conduit (21, 66, 67) that leads to the low-pressure chamber (65) for the fuel delivered from the low-pressure fuel system (27-29), the electric control magnet (17, 47-51) and the control valve (16), with a magnet valve housing (45), form a structural unit that is insertable as a whole into the fuel injector unit housing (1);

the magnet valve housing (45) is fastened between the injection pump (4) and the injection nozzle (6), and has a common end face with each of them;

a portion of the high-pressure conduit (9) extends from one end face to the other in the magnet valve housing (45), from said portion of the high pressure conduit said branch conduit (19) extends in the magnet valve housing (45) to the high-pressure chamber (54) of the control valve (16); and a low-pressure annular groove (66) is disposed between the fuel injector unit housing (1) and the magnet valve housing (45), said groove communicating on one end with the low-pressure conduit (21) that leads to the low-pressure chamber (65) and on the other end with a connecting bore (67) that leads to an outside of the fuel injector unit housing (1).

2. A fuel injector unit as defined by claim 1, in which the electric control magnet (17, 47-51) and the control valve (16) are disposed eccentrically in the magnet valve housing (45), and said portion of the high-pressure conduit (9) that extends through the magnet valve housing (45) extends on a side of the magnet valve housing (45) on which a greater accumulation of material resulting from the eccentricity is present.

3. A unit fuel injector as defined by claim 2, in which the fuel injector unit housing comprises a pump housing (34) which incorporates the injection pump (4) and for driving the injection pump a tappet (37) is connected to one end of the pump piston (7), and a union nut (41) fastens the magnet valve housing (45) and a nozzle holder (39) to the pump housing (34), and a nozzle unit (38) secures the injection nozzle (6) to the nozzle holder (39), and an intermediate plate (42) is secured between one end of said pump housing (34) and the magnet valve housing.

4. A unit fuel injector as defined by claim 2, in which a pressure equalization piston (56) is disposed on the movable valve member (46) in the low-pressure chamber (65) on a connecting neck (55), on a side of a valve seat (53) remote from the high-pressure chamber, said pressure equalization piston plunges into a damping bore (57), and for equalization of forces, a diameter of the movable valve piston (46) is approximately equivalent to an effective diameter of the valve seat, and a face end chamber (62) defining a space upstream of a face end of the pressure equalization piston (56) is largely pressure-relieved.

5. A fuel injector unit as defined by claim 4, in which a magnet chamber (23) surrounds the electric control magnet (17, 47-51), said face end chamber (62) and a nozzle spring chamber (63) are pressure relieved to an annular groove that is present between the magnet valve housing (45) and the fuel injector unit housing (1) and communicates with a leakage connection (31, 33) via a radial connection opening in the fuel injector unit housing (1).

6. A fuel injector unit as defined by claim 1, in which a filling of the pump work chamber (8) with fuel is effected via the control valve (16).

7. A unit fuel injector as defined by claim 6, in which the fuel injector unit housing comprises a pump housing (34) which incorporates the injection pump (4) and for driving the injection pump a tappet (37) is connected to one end of the pump piston (7), and a union nut (41) fastens the magnet valve housing (45) and a nozzle holder (39) to the pump housing (34), and a nozzle unit (38) secures the injection nozzle (6) to the nozzle holder (39), and an intermediate plate (42) is secured between one end of said pump housing (34) and the magnet valve housing.

8. A unit fuel injector as defined by claim 6, in which a pressure equalization piston (56) is disposed on the movable valve member (46) in the low-pressure chamber (65) on a connecting neck (55), on a side of a valve seat (53) remote from the high-pressure chamber, said pressure equalization piston plunges into a damping bore (57), and for equalization of forces, a diameter of the movable valve piston (46) is approximately equivalent to an effective diameter of the valve seat, and a face end chamber (62) defining a space upstream of a face end of the pressure equalization piston (56) is largely pressure-relieved.

9. A fuel injector unit as defined by claim 8, in which a magnet chamber (23) surrounds the electric control magnet (17, 47-51), said face end chamber (62) and a nozzle spring chamber (63) are pressure relieved to an annular groove that is present between the magnet valve housing (45) and the fuel injector unit housing (1) and communicates with a leakage connection (31, 33) via a radial connection opening in the fuel injector unit housing (1).

10. A unit fuel injector as defined by claim 1, in which a pressure equalization piston (56) is disposed on the movable valve member (46) in the low-pressure chamber (65) on a connecting neck (55), on a side of a valve seat (53) remote from the high-pressure chamber, said pressure equalization piston plunges into a damping bore (57), and for equalization of forces, a diameter of the movable valve piston (46) is approximately equivalent to an effective diameter of the valve seat, and a face end chamber (62) defining a space upstream of a face end of the pressure equalization piston (56) is largely pressure-relieved.

11. A fuel injector unit as defined by claim 10, in which an opening spring (18) that acts in an opening direction engages the movable valve member (46), said opening spring is disposed in the face end chamber (62).

12. A fuel injector unit as defined by claim 10, in which the face end chamber and a damping bore (57) for the pressure equalization piston (56) are disposed in a capsule (58) mounted on and secured to the magnet valve housing (45).

13. A fuel injector unit as defined by claim 10, in which a magnet chamber (23) surrounds the electric control magnet (17, 47–51), said face end chamber (62) and a nozzle spring chamber (63) are pressure relieved to an annular groove, that is present between the magnet valve housing (45) and the fuel injector unit housing (1) and communicates with a leakage connection (31, 33) via a radial connection opening in the fuel injector unit housing (1).

14. A fuel injector unit as defined by claim 13, in which an opening spring (18) that acts in an opening direction engages the movable valve member, said opening spring is disposed in the face end chamber (62).

15. A fuel injector unit as defined by claim 13, in which the face end chamber and a damping bore (57) for the pressure equalization piston (56) are disposed in a capsule (58) mounted on and secured to the magnet valve housing (45).

16. A fuel injector unit as defined by claim 15, in which the capsule (58) protrudes into a correspondingly coaxially disposed recess (59) of a nozzle holder (39) of the injection nozzle (6), and a leakage conduit connection (61) extends between the face end chamber (62) and the nozzle spring chamber (63), and said connection (61) communicates with said magnet chamber (23) via an additional leakage conduit (64).

17. A fuel injector unit as defined by claim 1, in which a connecting line (25) is present between the low-pressure chamber (65) and a magnet chamber (23), and said connecting line is provided with a throttle (26) so that continuous scavenging of a pressure-relieved region takes place.

18. A fuel injector unit as defined by claim 1, in which an intermediate plate (42) is present between the magnet valve housing (45) and the injection pump (4), a plurality of conduits (9, 100) for the fuel and for electrical connection pass through the intermediate plate and said plate is radially sealed off from the fuel injector unit housing (1, 41) by a sealing ring (43).

19. A fuel injector unit as defined by claim 18, in which the intermediate plate (42) on one side directly covers a magnet chamber (23) of the magnet valve housing (45) and on the other side covers the pump work chamber (8) of the injection pump (4).

20. A unit fuel injector as defined by claim 1, in which the fuel injector unit housing comprises a pump housing (34) which incorporates the injection pump (4) and for driving the injection pump a tappet (37) is connected to one end of the pump piston (7), and a union nut (41) fastens the magnet valve housing (45) and a nozzle holder (39) to the pump housing (34), and a nozzle unit (38) secures the injection nozzle (6) to the nozzle holder (39), and an intermediate plate (42) is secured between one end of said pump housing (34) and the magnet valve housing.

* * * * *